US005609417A

United States Patent [19]

Otte

[11] Patent Number: 5,609,417

[45] Date of Patent: Mar. 11, 1997

[54] APPARATUS FOR MIXING AND CIRCULATING CHEMICALS AND FLUIDS

[76] Inventor: Doyle D. Otte, Rte. 1, Box 139, Clarinda, Iowa 51632

[21] Appl. No.: 345,837

[22] Filed: Nov. 28, 1994

[51] Int. Cl.[6] ..... B01F 5/04

[52] U.S. Cl. ..... 366/137; 366/173.2

[58] Field of Search ..... 366/136–138, 366/159.1, 162.1, 165.1, 165.4, 165.5, 167.1, 173.1, 173.2, 181.6, 181.8, 182.2, 182.3, 182.4, 190, 191

[56] References Cited

U.S. PATENT DOCUMENTS

| | | | |
|---|---|---|---|
| 1,580,476 | 4/1926 | Fassio | 366/173.2 X |
| 2,603,460 | 7/1952 | Kalinske | 366/173.2 |
| 2,906,607 | 9/1959 | Jamison | 366/165.4 X |
| 3,512,713 | 5/1970 | Carlyon, Jr. | 366/136 X |
| 4,007,921 | 2/1977 | Zingg | 366/136 X |
| 4,045,004 | 8/1977 | Berger | 366/173.1 X |
| 4,121,767 | 10/1978 | Jensen . | |
| 4,385,034 | 5/1983 | Gacer . | |
| 4,790,454 | 12/1988 | Clark et al. . | |
| 5,335,690 | 9/1994 | Worth . | |
| 5,351,892 | 10/1994 | Conte . | |

FOREIGN PATENT DOCUMENTS

| | | | |
|---|---|---|---|
| 550642 | 9/1956 | Belgium | 366/136 |
| 1104630 | 11/1955 | France | 366/137 |

*Primary Examiner*—Charles E. Cooley
*Attorney, Agent, or Firm*—Zarley, McKee, Thomte Voorhees & Sease; Mark D. Frederiksen

[57] ABSTRACT

An apparatus for mixing chemicals and fluids includes a mixing tank with a cone-shaped funnel portion and an outlet in the lower end thereof. An ejector with a pair of spray nozzles sprays the mixture of liquid and chemicals drained from the tank outlet back into the tank. The nozzles are oriented with their axes parallel to one another and angled downwardly towards the surface of the liquid within the tank and on opposing sides of a line extending vertically from the center of the tank outlet. An hydraulic circuit is formed to circulate fluid drained from the tank back to the ejector, and a pump is provided to move the liquid within the circuit. A hose is connected in the circuit, with an operable valve to selectively exhaust the mixed chemical and diluent from the circuit to a spraying apparatus.

6 Claims, 3 Drawing Sheets

APPARATUS FOR MIXING AND CIRCULATING CHEMICALS AND FLUIDS

TECHNICAL FIELD

The present invention relates generally to apparatus for mixing chemicals and fluids, and more particularly to an improved apparatus which permits the mixing of dry or liquid chemicals with various fluids to provide a uniform mixture for sprayers or planters.

BACKGROUND OF THE INVENTION

Farmers have utilized various sprays, including pesticides, herbicides, and fertilizers, to make crop production more efficient and productive. Typically, the blending and dispensing of pesticides, fertilizers and the like was achieved by premixing a concentrate with a diluent and then dispensing the results and mixture through a sprayer or floater in the field.

One drawback of prior art premixers is in the restricted mixing capabilities of the mixer. In most cases, a mixer is designed either for mixing two liquids, a power and a liquid, or a dissolvable solid in a liquid. Thus, different mixing apparatus were required to produce a uniform mixture for a sprayer, depending upon the chemical and the diluent being utilized.

Another problem present in prior art mixing apparatus is in the consistency of the mixing. It is often difficult to consistently maintain a uniform mixture of chemicals and diluent.

Finally, the cleaning of the mixing unit of prior art apparatus required repetitive rinsing in order to remove sufficient chemicals such that the container is acceptable for disposal in a landfill.

SUMMARY OF THE INVENTION

It is therefore a general object of the present invention to provide an improved apparatus and method for mixing chemicals with diluent to produce a consistent and uniform mixture.

Another object is to provide a chemical mixer which thoroughly mixes a chemical with a diluent without mechanical agitators or the like.

Yet another object of the present invention is to provide an apparatus capable of mixing a diluent with a liquid, powder, or dissolvable solid.

A further object is to provide a chemical mixture which will effectively rinse a chemical container without requiring repetitive rinses.

Still another object of the present invention is to provide an improved method for mixing a chemical with a diluent which provides a consistent and uniform mixture throughout the spray cycle.

Another object is to provide a method for rinsing a chemical container to remove chemicals so as to permit disposal of the chemical container in a landfill.

These and other objects will be apparent to those skilled in the art.

The apparatus for mixing chemicals and fluids includes a mixing tank with a cone-shaped funnel portion and an outlet in the lower end thereof. An ejector with a pair of spray nozzles sprays the mixture of liquid and chemicals drained from the tank outlet back into the tank. The nozzles are oriented with their axes parallel to one another and angled downwardly towards the surface of the liquid within the tank and on opposing sides of a line extending vertically from the center of the tank outlet. An hydraulic circuit is formed to circulate fluid drained from the tank back to the ejector, and a pump is provided to move the liquid within the circuit. A hose is connected in the circuit, with an operable valve to selectively exhaust the next chemical and diluent from the circuit to a spraying apparatus.

DESCRIPTION OF THE PREFERRED EMBODIMENT

Figure 1:
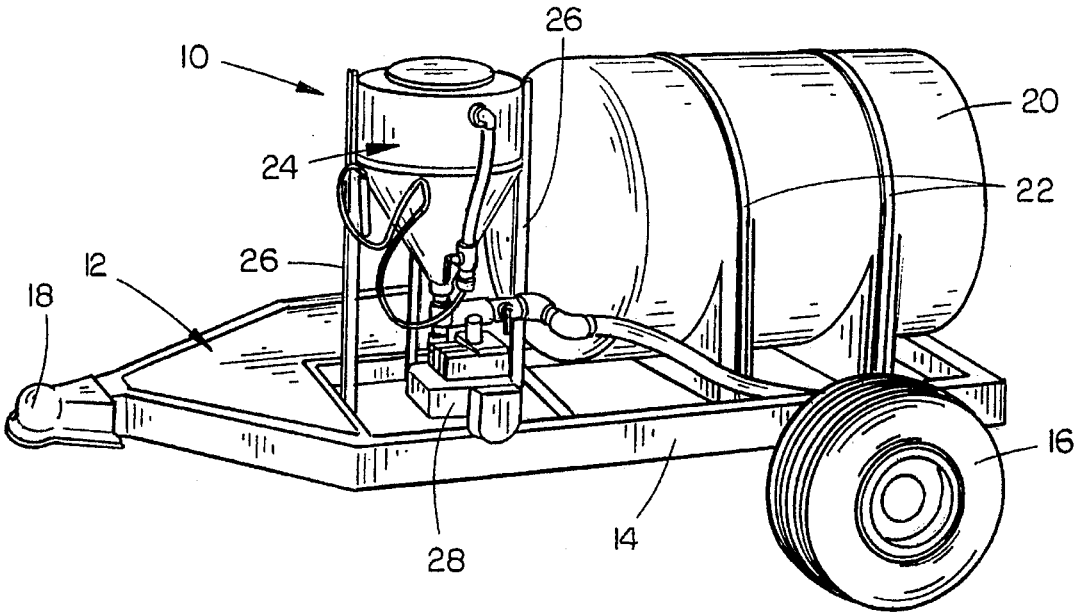
FIG. 1 is a perspective view of the chemical mixing apparatus of the present invention mounted on a transportable trailer.

Referring now to the drawings, in which similar or corresponding parts are identified with the same reference numeral, and more particularly to FIG. 1, the chemical mixing apparatus of the present invention is designated generally at 10 and is shown mounted on a trailer 12 for transport in the field.

Trailer 12 includes a frame 14 with a pair of wheels 16 for movably supporting the frame. A hitch 18 permits removable attachment of trailer 12 to a tractor or other prime mover. A drum 20 is mounted on trailer 12 and contains a supply of fresh water, fertilizer, or other diluent into which the desired chemical will be mixed and sprayed. A pair of straps 22 tie drum 20 to the trailer frame 14, in a conventional fashion.

Chemical mixing apparatus 10 includes a mixing tank 24 mounted on a plurality of vertical support posts 26 which maintain tank 24 in an upright orientation on trailer 12. A self-priming centrifugal pump 28 is supported on trailer frame 14 adjacent mixing tank 24. Preferably, pump 28 includes its own power unit (either electric or gas) and provides approximately 5 HP to pump 140 gallons per minute with 2 inch lines.

Figure 2:
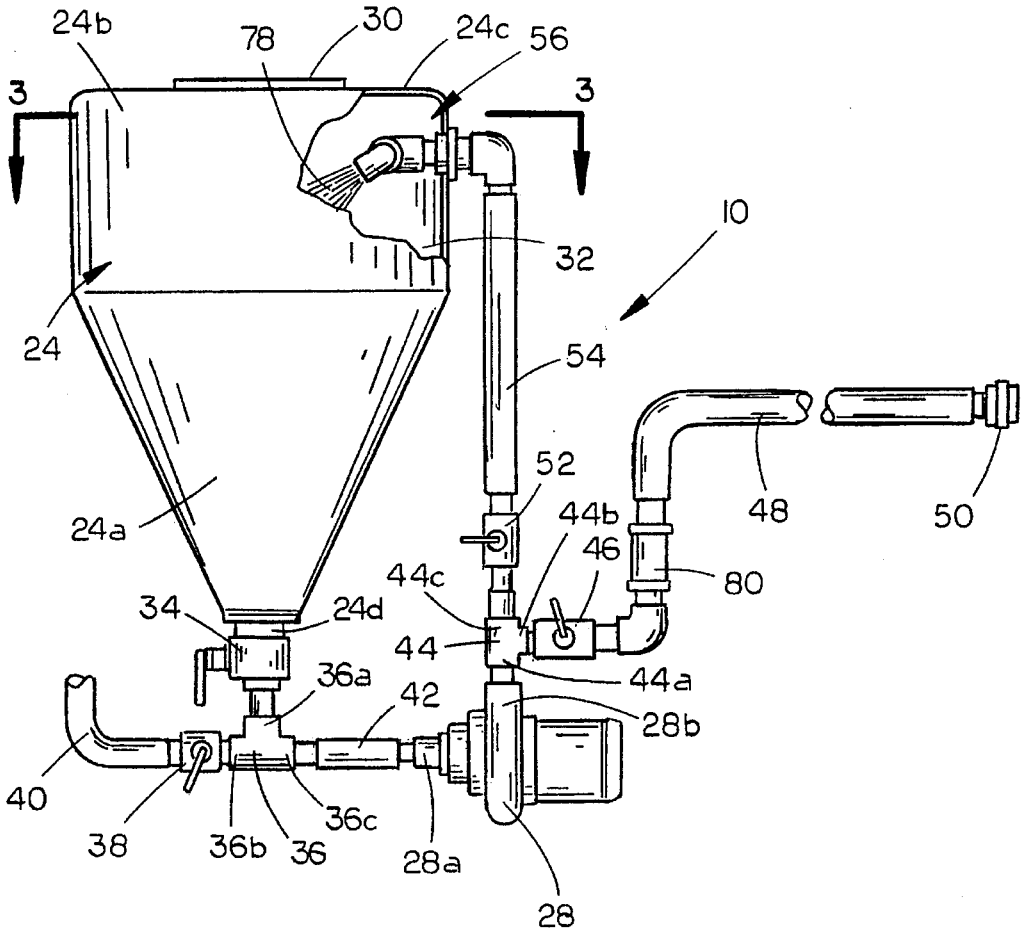
FIG. 2 is a side elevational view of the mixing container of the present invention, with a schematic view of the plumbing to the mixer.

Referring now to FIG. 2, mixing tank 24 includes a lower conical funnel portion **24*a* and an upper generally cylindrical portion 24*b*, with a removable lid 30 on the upper end 24*c* giving selective access to the interior cavity 32 of tank 24. An operable first valve 34 is mounted in the outlet 24*d* of mixing tank 24, and is operable between open and closed positions. First valve 34 is fluidly connected to an inlet port 36*a* of a "T" 36. A second inlet port 36*b* of "T" 36 is fluidly connected through a second valve 38 to a conduit 40 which extends to and is fluidly connected with drum 20 to supply fluid to chemical mixing apparatus 10. Second valve 38 is operable between open and closed positions, to selectively supply diluent fluid to the mixing apparatus 10**.

The outlet port **36*c* of "T" 36 is fluidly connected through tube 42 to the inlet 28*a* of pump 28. The outlet 28*b* of pump 28 is connected to the inlet port 44*a* of a "T" 44. One outlet port 44*b* of "T" 44 is connected via a third valve 46 to filler hose 48 having a quick coupler 50** on the distal end thereof.

Third valve 46 is operable between open and closed positions to selectively permit the flow of fluid through filler hose 48 to a sprayer or floater or the like connected via quick coupler 50.

The second outlet port 44*c* is fluidly connected through a fourth valve 52 and hose 54 to an ejector 56 mounted through the side wall of cylindrical portion 24*b* of mixing tank 24. Fourth valve 52 is also operable between open and closed positions, to selectively permit fluid flow therethrough.

Figure 3:
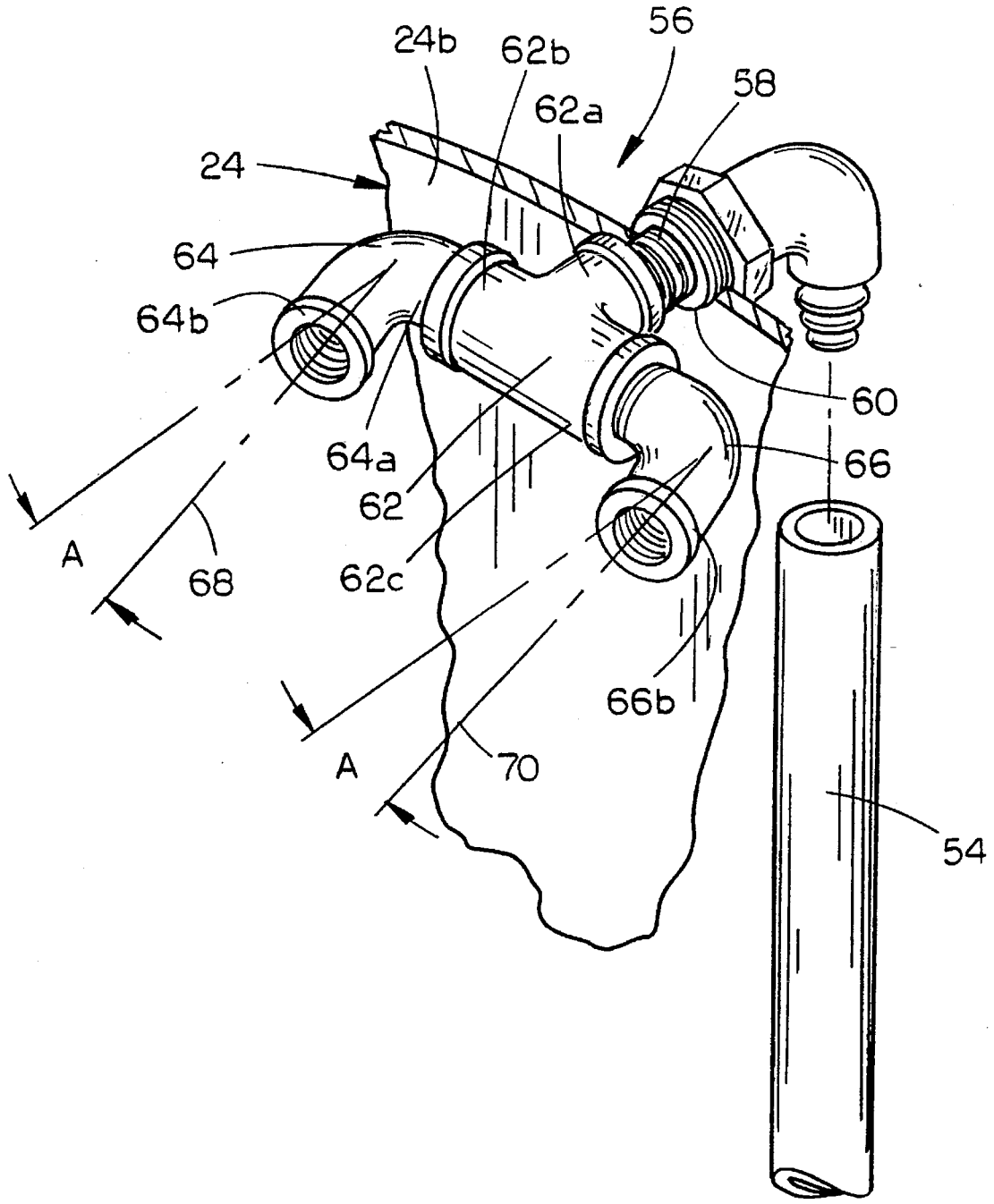
FIG. 3 is an enlarged perspective view of the spray nozzles within the mixing container.

Referring now to FIG. 3, ejector 56 includes an inlet tube 58 extending through an aperture 60 in the side wall of cylindrical portion 24*b* of mixing tank 24. Inlet tube 58 is connected to the inlet port 62*a* of a "T" 62, which has a pair of opposing, coaxial outlet ports 62*b* and 62*c*. A first elbow 64 has an inlet end 64*a* connected to outlet port 62*b* of "T" 62, and includes a reduced diameter outlet nozzle 64*b*. Similarly, a second elbow 66 is connected to outlet port 62*c* of "T" 62 with an outlet nozzle 66*b*.

As shown in FIG. 3, outlet nozzles 64*b* and 66*b* have generally parallel axes 68 and 70 respectively, lying within a plane sloped downwardly from horizontal, at an angle A.

Figure 4:
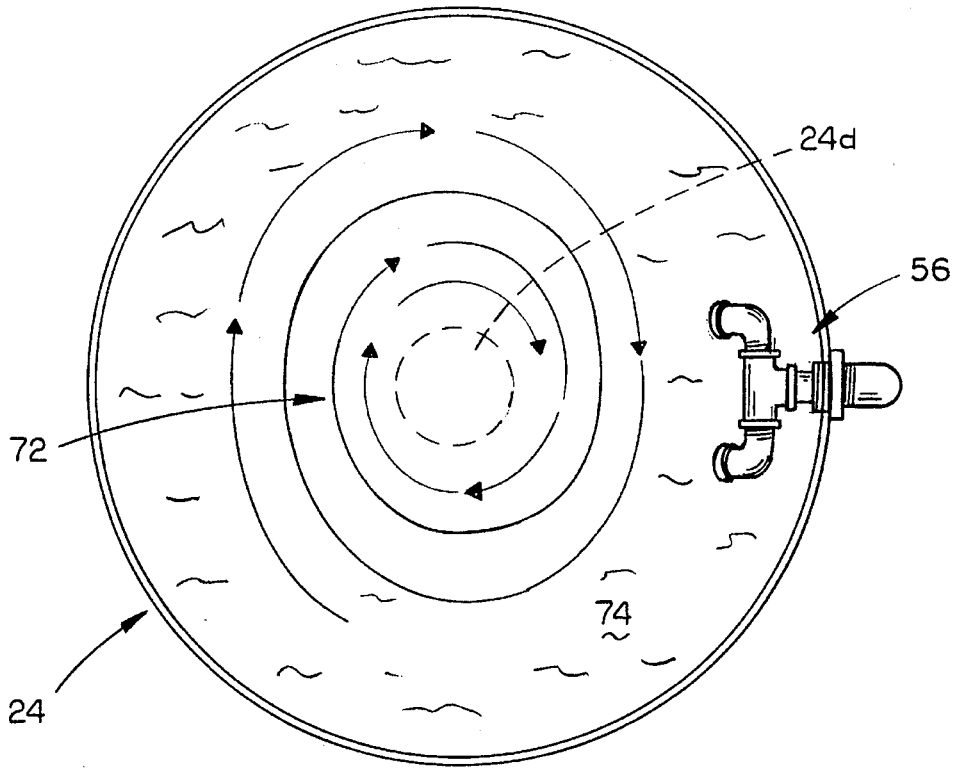
FIG. 4 is a sectional view taken at lines 3—3 in FIG. 2.
Figure 5:
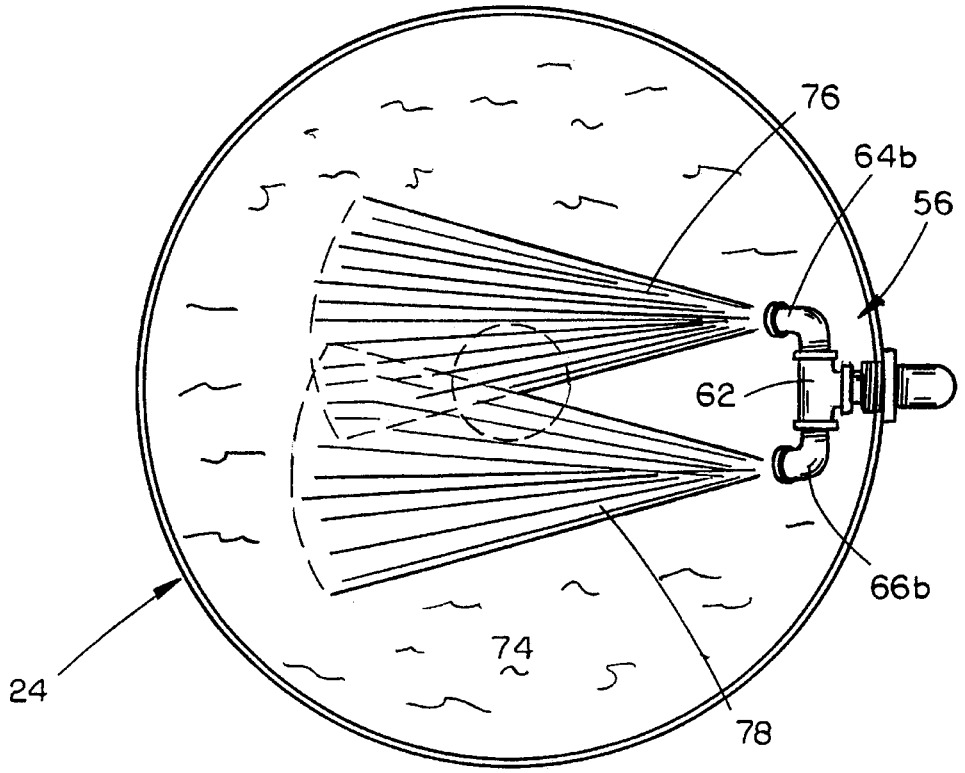
FIG. 5 is a sectional view similar to FIG. 3, during the mixing process.

Referring now to FIGS. 4 and 5, the effects of ejector 56 in mixing chemicals is shown. As shown in FIG. 4, a whirlpool 72 will naturally form within mixer tank 24 as liquid 74 is dispensed from outlet 24*d*. However, upon the activation of ejector 56, each outlet nozzle 64*b* and 66*b* will eject a spray 76 and 78 of fluid onto the surface of liquid 74. It has been found that sprays 76 and 78 interrupt the natural formation of the whirlpool (shown in FIG. 4), resulting in a bubbling mixing action within mixing tank 24.

In operation, first and third valves 34 and 46 are closed and second and fourth valves 38 and 52 are opened, to fill mixing tank 24 with fluid from drum 20 (see FIG. 1) through conduit 40. Once the liquid has reached a predetermined level within mixing tank 24, second valve 38 is closed and first valve 34 is opened, to recirculate fluid. This recirculation flows from mixing tank 24 through first valve 34, "T" 36, tube 42, pump 28, "T" 44, fourth valve 52, hose 54, and thence from ejector 56 to return to mixing tank 24. The desired chemical is added to mixing tank 24, via lid 30, or through a separate port in the mixing tank (not shown). As discussed above, the interruption of the natural formation of a whirlpool within mixing tank 24 by sprays 76 and 78, as shown in FIG. 5, causes a mixing action which thoroughly mixes the chemicals and diluent within mixing tank 24. The orientation of outlet nozzle 64*b* and 66*b* downwardly towards the surface of the liquid within mixing tank 24 assists in the interruption of the whirlpool effect. In addition, the reduction in diameter of the outlet nozzles 64*b* and 66*b* from the larger diameter of "T" 62, increases the velocity of sprays 76 and 78 to thereby further increase the mixing action within mixing tank 24. Because of the powerful mixing action, the inventor has found that it is possible to thoroughly mix chemicals in the form of liquid, dry flowables, dissolvable solids, oils and the like with a diluent such as water, fertilizer, or other liquids.

After a predetermined amount of mixing has occurred, first and fourth valves 34 and 52 are closed to prevent further mixing. A sprayer or other apparatus may then be connected to filler hose 48 via coupler 50. To fill the sprayer with a combination of diluent and mixed chemicals, first, second and third valves 34, 38 and 46 are all opened. Thus, liquid from drum 20 and a chemical mixture from mixing tank 24 are intermixed at "T" 36 and pumped through valve 46 and filler tube 48 to the sprayer or other container.

By opening fourth valve 52 during the process of filling a sprayer through filler tube 48, a portion of the fluid being pumped by pump 28 is recycled through mixing tank 24 to rinse the interior of the mixing tank. Typically the step of rinsing tank 24 will be taken after all chemicals within the mixing tank have been drained and pumped into the sprayer. In this way, only fresh water from conduit 40 flows through pump 28 and ejector 56 for spraying the interior of tank 24. Once tank 24 has been thoroughly rinsed, fourth valve 52 is again closed so that the rinse water within tank 24 will be drained and pumped into the sprayer. Once the sprayer has been filled to the desired level, all valves 34, 38, 46 and 52 are closed.

The inventor preferably interposes a strainer 80 in filler hose 48 to permit removal of foreign objects from the fluid flowing therethrough, as shown in FIG. 2.

Whereas the invention has been shown and described in connection with the preferred embodiment thereof, many modifications, substitutions and additions may be made which are within the intended broad scope of the appended claims.

I claim:

1. A transportable chemical mixing system, comprising:

a trailer having a pair of wheels for moving the trailer over ground, a hitch at a forward end for connecting the trailer to a prime mover, and a frame;

a drum for storing diluent fluid, removably mounted on said trailer frame;

a mixing tank for mixing chemicals with diluent fluid from the drum, mounted on the trailer frame;

said mixing tank having a lower cone-shaped funnel portion with an outlet centered in a lower end and an upper portion with a removable lid on an upper end;

liquid within said tank forming a vortex with a vertical axis passing through the outlet as the liquid is dispensed from the outlet;

an ejector disposed within said tank upper portion, for ejecting a liquid into the tank and mixing the ejected liquid with the liquid within the tank, said ejector including:

a pair of spaced apart outlet nozzles for dispensing fluid from the ejector;

said nozzles having axes along which liquid is sprayed and which are generally parallel to one another and spaced equally apart on diametric sides of the vortex axis;

said nozzle spray axes oriented downwardly at an angle from horizontal to direct liquid sprayed from the nozzles into the liquid in the tank forming the vortex, to thereby disrupt the vortex;

an hydraulic circuit fluidly connecting the tank outlet and the ejector, to circulate fluid from the tank through the ejector and back to the tank;

a pump interposed in said hydraulic circuit for moving liquid within the circuit in a direction from the tank outlet to the ejector;

a conduit extending from the drum and connected to the hydraulic circuit upstream of said pump to provide diluent fluid from the drum to the circuit;

a hose having an inlet end connected to said hydraulic circuit downstream of said pump to direct fluid from the circuit to a distal end of the hose; and means on the distal end of the hose for connecting the hose to fluid dispensing apparatus.

2. The chemical mixing system of claim 1, wherein said nozzle axes are generally coplanar.

3. The chemical mixing system of claim 1, further comprising an operable first valve located in the hose for selectively permitting fluid flow through the hose from the hydraulic circuit.

4. The chemical mixing system of claim 3, further comprising an operable second valve within said conduit for selectively permitting fluid flow from the drum to the hydraulic circuit.

5. The chemical mixing system of claim 4, further comprising an operable third valve in the tank outlet, upstream of the connection of the conduit to the hydraulic circuit, for selectively preventing fluid flow from the mixing tank.

6. The chemical mixing system of claim 5, further comprising an operable fourth valve interposed in the hydraulic circuit upstream of the ejector and downstream of the connection of the hose to the hydraulic circuit, for selectively preventing fluid flow to the ejector.

* * * * *